United States Patent [19]

Chandler et al.

[11] Patent Number: 5,057,809

[45] Date of Patent: Oct. 15, 1991

[54] VARIABLE INDUCTANCE RF COIL ASSEMBLY

[75] Inventors: Alan S. Chandler, Redmond; Emile F. Alline, Jr., Lynwood, both of Wash.

[73] Assignee: Advanced Electronics, Inc., Lynnwood, Wash.

[21] Appl. No.: 456,337

[22] Filed: Dec. 26, 1989

[51] Int. Cl.[5] ..... H01F 29/02

[52] U.S. Cl. ..... 336/144; 336/150

[58] Field of Search ..... 336/137, 144, 150; 323/340, 341, 347

[56] References Cited

U.S. PATENT DOCUMENTS

| | | | |
|---|---|---|---|
| 978,604 | 12/1910 | Marriott . | |
| 1,679,503 | 8/1928 | Siegrist . | |
| 2,691,141 | 10/1954 | Hollis | 336/139 |
| 3,265,997 | 8/1966 | Olson | 333/73 |
| 3,958,196 | 5/1976 | Benzie et al. | 334/71 |
| 4,255,734 | 3/1981 | Owen | 336/150 X |

OTHER PUBLICATIONS

The Radio Amateur's Handbook, American Radio Relay League, 29th Ed., 1952, pp. 455–456.

The Radio Amateur's Handbook, American Radio Relay League, 40th Ed., 1963, p. 70.

The Radio Amateur's Handbook, American Radio Relay League, 52nd Ed., 1975, p. 26.

*Primary Examiner*—Thomas J. Kozma

*Attorney, Agent, or Firm*—David B. Harrison

[57] ABSTRACT

A variable inductance RF coil assembly including an air-core, high-voltage coil, a printed circuit board installed inside of the coil, the circuit board carrying a plurality of switch contacts corresponding in location and in number to the turns of the air coil, a contact plate attached to the circuit board and having contact fingers corresponding in location and in number to the switch contacts, and a rotary, stepped cam cylinder mounted to the circuit board, the cams corresponding in location and number to cam-follower sections of the contact arms on the contact plate. Unidirectional rotation of the stepped cam cylinder causes progressive communication between the cam steps and the cam-follower sections. Such communication causes the contact arms to connect with the switch contacts on the circuit board thereby progressively and continuously shorting out each successive turn of the coil thereby to adjust the inductance thereof.

18 Claims, 4 Drawing Sheets

VARIABLE INDUCTANCE RF COIL ASSEMBLY

FIELD OF THE INVENTION

The present invention relates to a variable inductance coil assembly. The invention finds special application for high frequency radio transmission and/or receiving systems.

BACKGROUND OF THE INVENTION

High frequency range radio transmitters operate throughout a broad range of frequencies. "High frequency" refers to a portion of the frequency spectrum lying between 3 and 30MHz. Air coil inductors are frequently included within high frequency radio systems to establish the operating frequency(s) thereof, and a number of methods have been used to alter the inductance of the coil.

One prior art approach for varying the inductance of a coil has been to mount the coil for rotation about its longitudinal axis. Rods or bars having a contact wheel, or other single projection that engages and follows the coil as it rotates, have been attached to a framework surrounding the coil. Rotation of the coil causes the contact wheel to travel along the length of the coil, thereby providing a continuously variable tap. Typically, the rod or bar is electrically connected to one end of the rotatable coil, so that all of the turns between the connection and the contact wheel are bridged and are thereby nominally shorted out. While the rod-contact wheel variable coil operates generally satisfactorily at the lower end of the high frequency spectrum, parasitic capacitance may develop across the turns of the coil when the coil is set to resonate at a high frequency. Parasitic capacitance within the coil structure itself may result in the formation of an undesirable high frequency, parallel resonance circuit which may act as a trap and absorb significant RF energies intended for other elements or stages of the radio system. Because the coil is mounted for rotation, brushes must be provided to connect to at least one end of the coil. When such a coil is used for transmitting, the possibility of corona discharge or sparking creates ozone which results in tarnishment of the brush contact surfaces. Intermittencies, spurious signals and parasitic oscillations that interfere with the operation of the circuit may result. The use of a rod and contact wheel and supporting framework to vary inductance may also increase the amount of space required to accommodate the variable inductor assembly within the radio system.

A similar prior approach has been to provide a longitudinally positionable bar carrying a rotating contact wheel which effectively rolls over the turns of the coil in order to vary the inductance thereof. This approach had the drawbacks noted for the rotating coil discussed above. In addition, the sliding adjustment bar has not seen widespread use, since adjustment of inductance has typically been accomplished by rotation of a control knob at the control panel of the radio apparatus.

Another prior approach to varying inductance called for connecting wires, commonly known as taps, at various locations throughout the coil and extending the wires to contact switches located at some distance from the coil, as in the Siegrist U.S. Pat. No. 1,679,503. The use of many taps may also result in the formation of undesirable parallel resonance circuits and a lowered overall Q factor for the circuit, thereby reducing the sharpness of the circuit response at the selected frequency. One other prior art approach used to vary inductance includes the use of a motorized, shorting drum structure interior to the coil as in the Hollis U.S. Pat. No. 2,691,141, and the Olson U.S. Pat. No. 3,265,997. The Hollis and Olson drum structures may create parallel resonance problems, and the auxiliary motors and drums also require additional space within the radio system.

Yet another prior approach used to vary inductance placed the coils within a sliding framework as shown in the Marriott U.S. Pat. No. 978,604. The entire coil was moved in and out of the system to vary the inductance.

One additional prior approach to vary inductance is shown in the Benzie et al. U.S. Pat. No. 3,958,196. This approach is somewhat similar to the sliding bar approach noted above. A motor driven pulley apparatus is used to pull a conductive tape through the interior of the coil to progressively short out the windings of the coil. The motor and the pulley system take up space within the radio system and may create parallel resonance problems.

Additional problems with the prior art approaches arose from the use of rods, multiple wires, drums, and auxiliary motors and mounting structures. Such structures are typically conductive, and arcing to surrounding conducting structures can occur, thereby contributing to the creation of parallel circuits between the rods, wires, drums, or motors and the surrounding structures, such as the transmitter enclosure or housing. Additionally, a circuit that uses a single tap or single shorting connection to short out all turns up to the location of the tap is particularly prone to the formation of undesirable parallel resonance circuits.

As can be seen from the discussion of the prior art, an unsolved need exists for an improved variable inductor which overcomes the limitations and drawbacks of the prior art designs.

SUMMARY OF THE INVENTION WITH OBJECTS

A general object of the present invention is to provide a variable RF coil assembly which overcomes the limitations and drawbacks of the prior art.

A specific object of the present invention is to provide a compact, low cost variable RF coil assembly having all components within the interior of the coil, thereby requiring no additional space within the radio assembly. Another specific object of the present invention is to provide a variable RF coil assembly having all components interior to the coil thereby eliminating the creation of parallel resonance within the coil and with the surrounding structures in the radio assembly.

A further specific object of the present invention is to provide a variable RF coil assembly with improved means for changing the inductance of a coil and enabling high frequency radio operation, above 20 megahertz, without reducing the Q factor of the circuit.

One further specific object of the present invention is to provide a variable RF coil assembly having reduced parasitic capacitance.

Yet one more specific object of the present invention is to provide a variable RF coil assembly that effectively and progressively shorts out each turn of the coil as the inductance varying element is rotatably adjusted by manipulation of a control knob at the panel of the radio apparatus.

In accordance with the present invention, a variable inductance RF air coil assembly is provided having all of the components required to vary the inductance of the coil mounted inside the coil. In one presently preferred form, the assembly includes the following components: an air-core, high-voltage coil, a printed circuit board inside of the coil to which the turns of the coil are mounted for spacing and mechanical rigidity, the circuit board carrying a plurality of switch contacts corresponding in location and in number to the turns of the air coil, a contact plate attached to the circuit board and having contact arms corresponding in location and in number to the switch contacts, and a rotary, progressively stepped cam cylinder mounted to the circuit board, the cams corresponding in location and number to the contact arms on the contact plate.

In operation, rotation of the stepped cam cylinder in one direction causes progressive communication between the cam steps and the contact arms. Such communication causes the contact arms to connect to the switch contacts on the circuit board, thereby progressively and continuously shorting out each successive turn of the air coil.

These and other objects, aspects, advantages and features of the present invention will be more fully understood and appreciated upon consideration of the following detailed description of a preferred embodiment, presented in conjunction with the accompanying drawings.

DETAILED DESCRIPTION OF A PREFERRED EMBODIMENT

Figure 2:
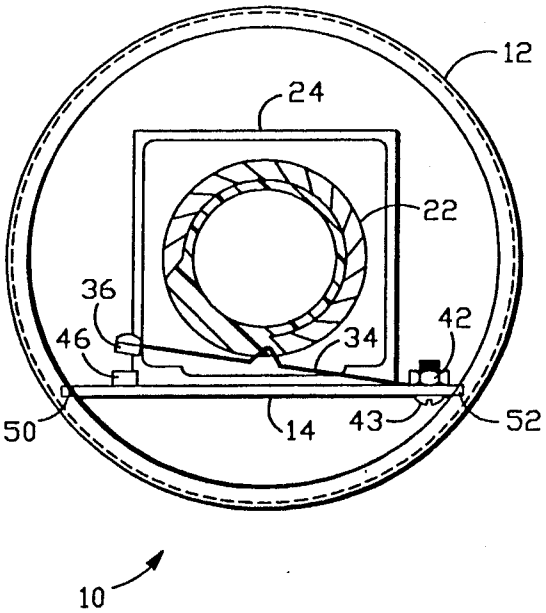
FIG. 2 is a transverse end view in elevation and section of the FIG. 1 coil assembly, taken along the line 2-2 in FIG. 1.

Referring now to FIG. 1 to 7, a variable inductance RF coil assembly incorporating the principles of the present invention is shown generally at 10. The coil assembly 10 includes an RF air coil 12, a printed circuit board mounting substrate 14, stand-off insulators 16 and a base 18 to which the coil assembly 10 is mounted for use. A shaft 20 extends from one end of the coil assembly. Rotation of the shaft 20 varies the inductance of the coil in progressive steps, as will now be explained.

A rotary stepped cam 22 is mounted within the coil 12 between two universal bearing blocks 24. The bearing blocks 24 provide end journals for the cam 22 and enable the cam 22 to be rotated by the shaft 20. The cam 22 defines a series of progressive steps 26 which extend circumferentially about the cam The steps 26 extend from a radially inner circumference 28 along a single longitudinal boundary 29 to a radially outer circumference 30 which occurs progressively with the rotation of the cam 22 at the radial position of each step 26. The steps 26 are spaced around the circumference of the cam 22 and are spaced along the longitudinal dimension thereof, as best illustrated in FIGS. 3 and 4.

Figure 3:
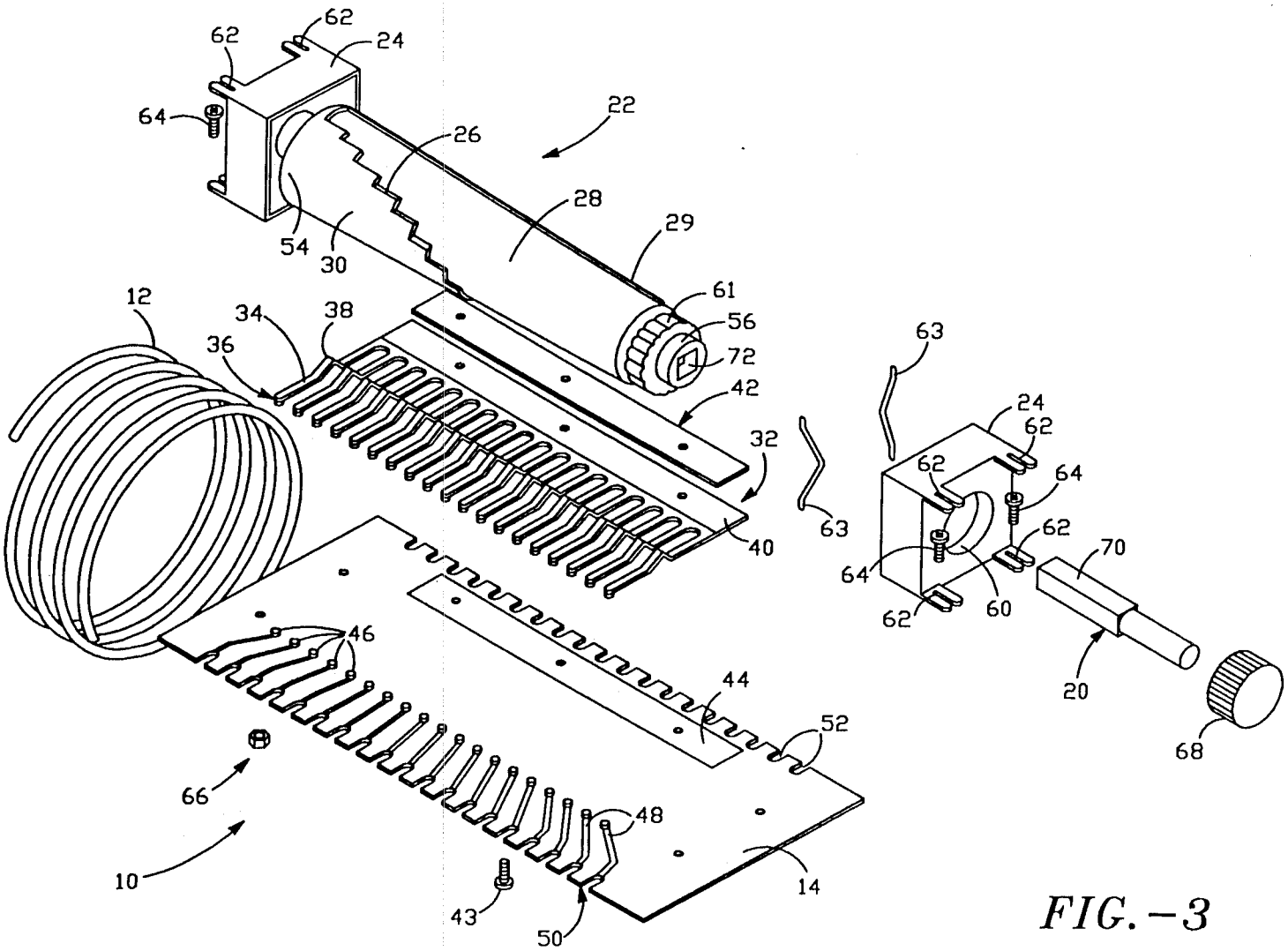
FIG. 3 is an explosion assembly drawing in perspective view of the FIG. 1 coil assembly.
Figure 4:
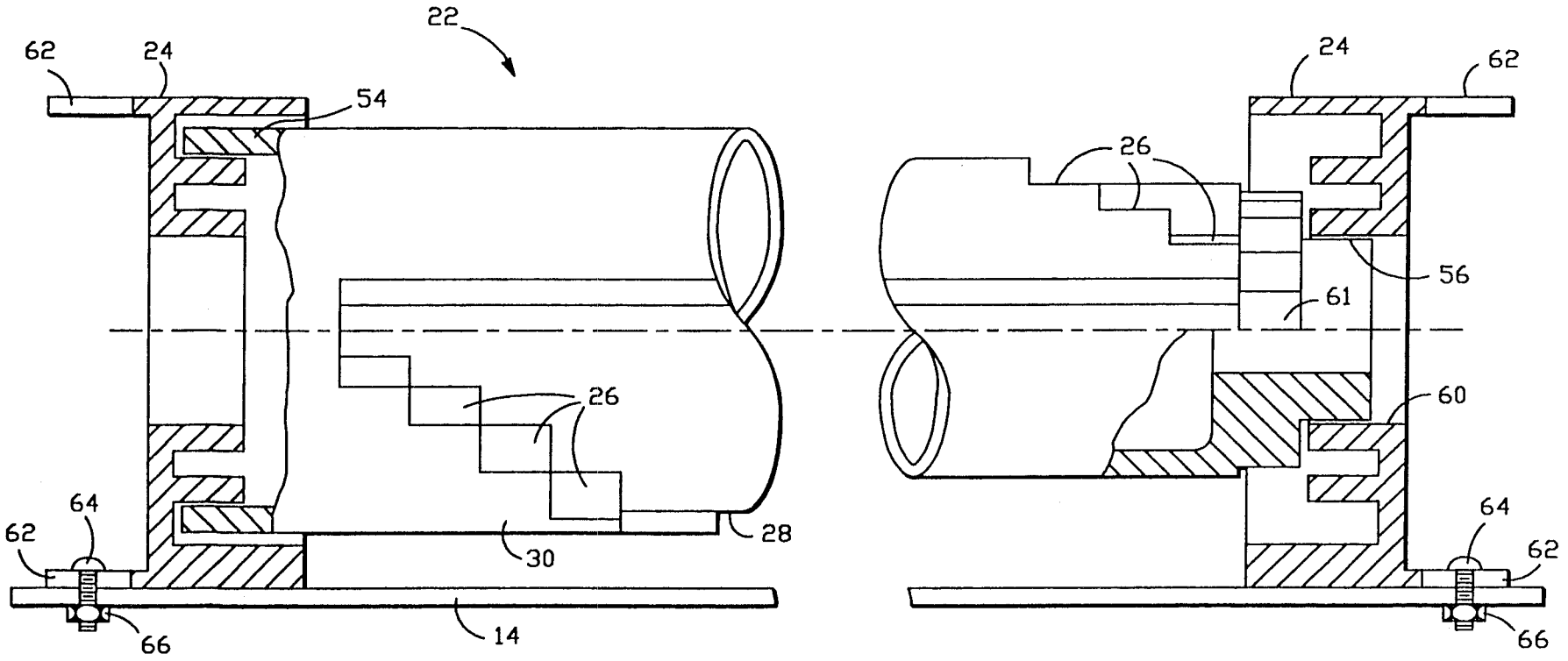
FIG. 4 is an enlarged view in side elevation and partial section of the stepped spiral cam and universal bearing blocks of the FIG. 1 coil assembly.
Figure 6:
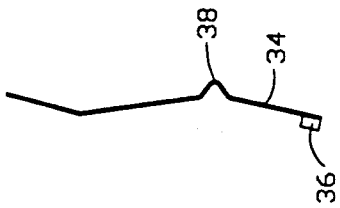
FIG. 6 is an end view in elevation of the FIG. 5 finger contact assembly.
Figure 7:
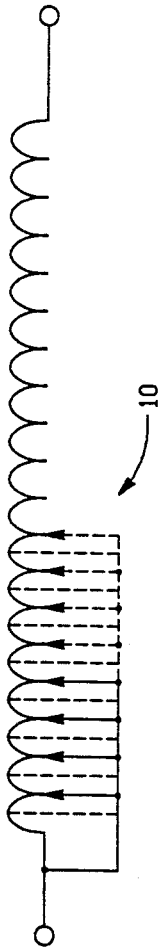
FIG. 7 is an end view of the stepped spiral cam, showing the cam steps in relation to a detent-providing scalloped annular end region of the cam.
Figure 5:
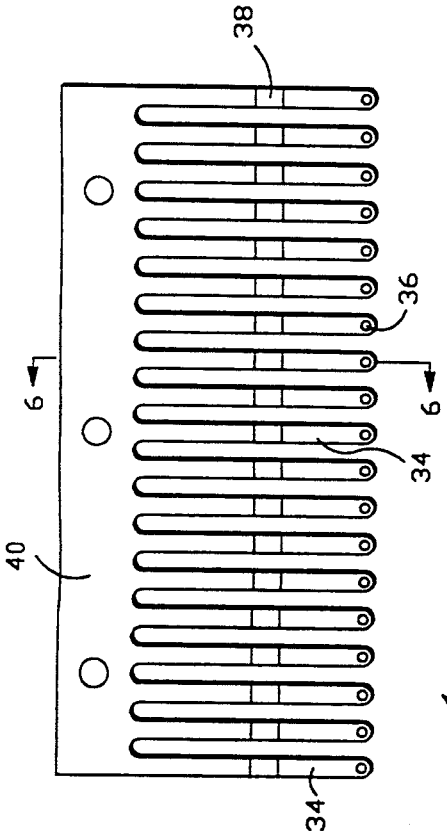
FIG. 5 is a bottom plan view of a finger contact assembly 1 of the FIG. 1 coil assembly.

A finger contact assembly 32, best seen in FIGS. 3, 5 and 6, defines a series of fingers 34. The contact assembly 32 is made of a copper beryllium alloy having an approximate thickness of 12 millimeters. A contact 36 having a silver alloy overlay is disposed at the end of each of the contact fingers 34. Each silver-plated electrical contact 36 is swaged onto the outer end of the finger. Each finger 34 is also provided with a Vee shaped cam follower region 38 which is intermediate the contact end and a common, mounting end 40. The common, mounting end 40 defines a shallow angle with the fingers 34, so that when the assembly 32 is mounted to the circuit board 14, each of the cam follower regions 38 of the fingers 34 is biased to bear against, and follow, an annular region of the cam 22 which includes a respective step 26. A mounting bar 42 is provided to secure the common, mounting end 40 of the contact assembly 32 against the printed circuit board 14. The mounting bar 42 is considerably thicker than the assembly 32 and provides requisite rigidity for secure mounting to the printed circuit board 14. A series of threaded holes in the bar are engaged by screws 43 to secure the plate and the mounting end of the contact assembly to the printed circuit board 14. A plated region 44 of the printed circuit board 14 enables a positive electrical contact to be made with the contact assembly 32.

A series of fixed contacts 46 are provided on the printed circuit board in registration with the contacts 36 of the fingers 34. When a finger 34 follows the radially inner circumference 28 of the cam, its contact 36 is spaced away from the corresponding fixed contact 46. When the finger 34 follows the radially outer circumference 30 of the cam, the finger contact 36 comes into electrical connection with its corresponding fixed contact 46. A series of connection traces 48 extend from the fixed contacts 46 to U-shaped plated mounting regions 50 formed along one longitudinal edge of the printed circuit board 14. The coil 12 is soldered or otherwise conductively affixed to the printed circuit board at the U-shaped mounting regions 50. Similar regions 52 are arranged on the opposed longitudinal edge of the printed circuit board 14 in accordance with the winding pitch of the coil 12; and the turns of the coil 12 are also attached to the regions 52 along this edge.

The cam 22 is preferably injection molded of a suitable non-conductive plastic material, such as Valox (tm) polyester polymer resin, for example, and is therefore slightly tapered so as to be easily removable from an injection mold. It is molded as a tube having a radially outer end 54 and a radially inner end 56, as seen in FIGS. 3 and 4. The universal bearing blocks 24 are also injection-molded of non-conductive plastic material, and they are formed to have an outer bearing annulus 58 which is sized to receive the outer end 54, and to define an inner bearing annular opening 60 for receiving the inner end 56. Thus, the bearing blocks 24 are identical in size and journal the cam 22 at both ends. A detent providing, scalloped annular region 61 of the cam 22 is followed by two detent springs 63 which are mounted within the bearing block 24 receiving the inner end 56 of the cam 22. The region 61 has a detent pitch corresponding to the angular pitch of the spaced cam steps 26 and is provided adjacent the inner radial end 56 of the cam 22.

Four mounting tabs 62 extend from the main body of the bearing block 24 and two of the tabs enable it to be mounted by screws 64 and nuts 66 to the printed circuit board 14. The four-tab arrangement enables each block 24 to accommodate the radially outer end 54 and the radially inner end 56 of the cam 22.

Figure 1:
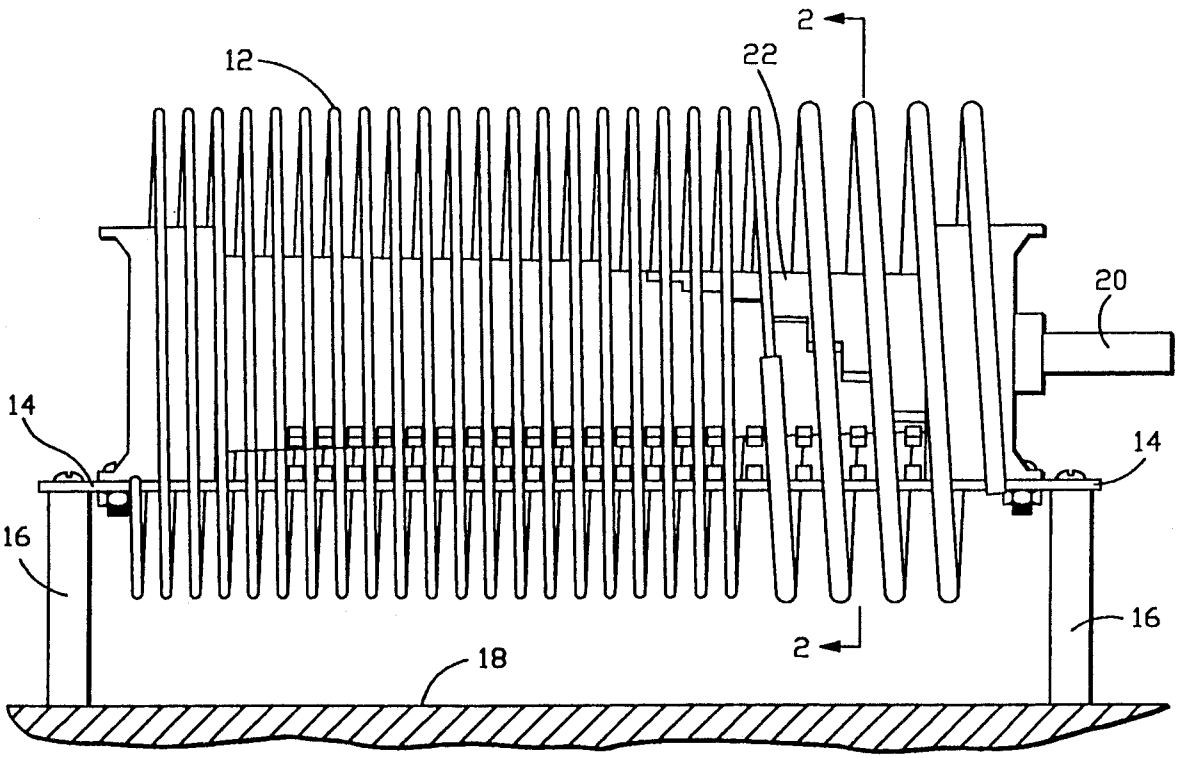
FIG. 1 is a somewhat diagrammatic side view in elevation of a variable inductance coil assembly in accordance with the principles of the present invention.

The coil 12 may be of fixed pitch, or variable pitch, and it may include segments of differing diameter conductors in order to provide less resistance (higher Q) at the desired operating frequency. The coil 12 is shown in FIG. 1 with 25 turns, four of which are comprised of a silver-plated tubular conductor, and the balance of which are comprised of a silver plated wire. There are 19 separate fingers 34, and so there are 19 taps which may be progressively made to the coil 12, thereby to vary its inductance.

Figure 8:
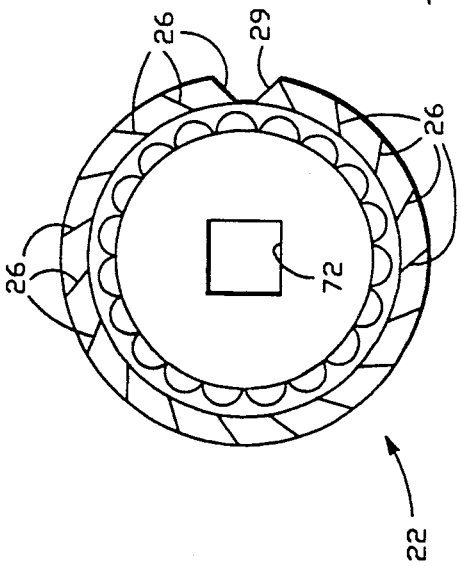
FIG. 8 is an electrical circuit schematic of the FIG. 1 coil structure.

As is apparent to those skilled in the art, as the cam 22 is rotated, as by manipulation of a suitable control knob 68, the tapping arrangement progressively shorts out the turns between each tap, as is graphed in FIG. 8, thereby minimizing the effect of distributed or stray capacitance upon the resultant inductive structure. In this manner, high frequency parasitic resonances in the coil structure 10 are completely avoided.

When the variable inductance RF coil assembly lo is assembled and the knob 68 is rotated, the detents 61 and detent springs 63 limit unidirectional rotary movement of the cam cylinder 22 to a step by step progression. Each rotation step results in contact engagement of a cam step 26 with its corresponding cam-follower segment 38 of contact plate 32. As each cam step 26 engages its cam-follower segment 38, the corresponding contact finger 34 is lowered and contact is made between the finger contact 36 and the corresponding fixed contact 46 on the circuit board 14. Such contact enables progressive and continuous shorting out of each successive turn of the air coil 12. All but one or several turns may be shorted out which applies a minimum inductance of the RF coil 12 to an associated circuit. Further unidirectional rotation of the knob will cause the cam-follower segments 34 to reach the longitudinal wall 29 (see FIG. 3) at which point the follower segments 34 move upwardly and thereby raise all contacts 36 to break the connections with corresponding fixed switch contacts 46 and re-configure the RF coil assembly 10 to have a maximum inductance value. Further unidirectional rotation of the knob 68 causes a repeat of the progressive switching action of the coil assembly. The shaft 20 may be of brass and have a squared portion 70 which may engage a suitably mating squared opening at the radially inner end 56 of the cam 22.

Although the presently preferred embodiment of the invention has been illustrated and discussed herein, it is contemplated that various changes and modifications will be immediately apparent to those skilled in the art after reading the foregoing description in conjunction with the drawings. For example, the variable inductance RF coil assembly may be adapted to short out one or more turns of any induction coil in order to vary the inductance thereof. The cam and cam-follower structures may be modified to include other cam and follower configurations. The RF coil assembly may be adapted for use in radio circuits, or in other circuits requiring variable inductance. The contact plate 40 may be constructed from any suitable conductive material or alloy. A high permeability slug may be fixedly or adjustably positioned within the cam structure 22 to further adjust and vary the inductance of the coil 10.

Accordingly, it is intended that the description is by way of illustration and should not be deemed limiting to the invention, the scope of which being more particularly specified and pointed out by the following claims.

What is claimed is:

1. A variable inductor assembly for radio frequency energy comprising:

a multi-turn substantially helical coil comprising a plurality of turns, successive turns of the coil having a tap terminating in a fixed switch contact, there being a plurality of fixed switch contacts;

a mounting substrate means of dielectric material for mounting the turns of the coil and for mounting the fixed switch contacts; and a cam and follower switching assembly mounted to the mounting substrate means, the switching assembly including a rotatable non-conductive cam and a follower having conductive fingers which are biased mechanically to follow the cam and which are electrically connected in parallel, and further including moving contacts which are carried by the fingers, the moving contacts being aligned and adapted to make progressive contact with aligned corresponding ones of said fixed contacts as the cam is rotated thereby progressively to short out the successive turns connected to said ones of said fixed contacts actually contacted by said moving contacts.

2. The variable inductor assembly set forth in claim 1 wherein the cam and follower switching assembly are mounted longitudinally within an interior space defined by the multi-turn coil.

3. The variable inductor assembly set forth in claim 2 wherein the rotatable cam defines progressive discrete steps aligned with the fingers, and further comprising detent providing means associated with the rotatable cam for limiting the rotation of the cam to steps which correspond in pitch substantially with the positions of the steps.

4. The variable inductor assembly set forth in claim 1 wherein the mounting substrate means comprises a printed circuit board.

5. The variable inductor assembly set forth in claim 4 wherein the printed circuit board is substantially rectangular and has opposed longitudinal edges and end edges.

6. The variable inductor assembly set forth in claim 5 further comprising plated through edge notches formed in the longitudinal edges, each notch for engaging a segment of a turn of the multi-turn coil, and bonding means for bonding the segment to the notch, thereby to support and align the coil.

7. The variable inductor assembly set forth in claim 6 wherein the fixed switch contacts are arranged in a longitudinal row and are affixed to the printed circuit board, and further comprising conductive paths extending from a notch on one longitudinal edge to a corresponding fixed switch contact, thereby to connect the segment bonded to the notch to a corresponding fixed contact mounted to the printed circuit board.

8. The variable inductor assembly set forth in claim 7 wherein the follower comprises a longitudinal mounting strip secured to the printed circuit board and wherein the fingers extend from the mounting strip.

9. The variable inductor assembly set forth in claim 18 wherein the rotatable cam defines progressive discrete steps aligned with the fingers, and further comprising detent providing means associated with the rotatable cam for limiting the rotation of the cam to steps which correspond in pitch substantially with the positions of the steps and wherein the fingers are formed as leaf springs extending from the mounting strip, each leaf spring having an inverted Vee medial cam-follower portion for following a corresponding annular segment of the cam which includes a said step.

10. The variable inductor assembly set forth in claim 4 wherein the rotatable cam is mounted to the printed circuit board by two mounting blocks secured adjacent to the opposite end edges of the printed circuit board, the mounting blocks forming journals which enable the cam to rotate.

11. The variable inductor assembly set forth in claim 10 wherein the rotatable cam defines progressive discrete steps aligned with the fingers, and further comprising detent providing means formed in at least one of the blocks and associated with the rotatable cam for limiting the rotation of the cam to steps which correspond in pitch substantially with angular positions of the steps, so that each detent corresponds to a predetermined connection arrangement between the fixed contacts and the contacts carried by the fingers.

12. A variable inductor assembly for radio frequency energy comprising:

a multi-turn substantially helical coil comprising a plurality of turns, each turn of the coil being spaced away from an adjacent turn by a predetermined space, successive turns of the coil having a tap terminating in a fixed switch contact, there being a plurality of fixed switch contacts;

a mounting substrate means of dielectric material for mounting the turns of the coil to provide and maintain the predetermined space between each turn and for mounting the fixed switch contacts; and a cam and follower switching assembly mounted to the mounting substrate means longitudinally within an interior space defined by the multi-turn coil, the switching assembly including a rotatable non-conductive cam and a follower having conductive fingers which are biased mechanically to follow the cam, and further including moving contacts which are carried by the fingers, the moving contacts being aligned and adapted to make contact with aligned corresponding ones of said fixed contacts as the cam is rotated.

13. The variable inductor assembly set forth in claim 12 wherein the rotatable cam defines progressive discrete steps aligned with the fingers, and further comprising detent providing means associated with the rotatable cam for limiting the rotation of the cam to steps which correspond in pitch substantially with the positions of the steps.

14. The variable inductor assembly set forth in claim 12 wherein the mounting substrate means comprises two rows of edge notches formed along two substantially parallel edges, each notch for engaging and thereby aligning a segment of a said turn of the multi-turn coil, and bonding means for bonding the segment to the

15. The variable inductor assembly set forth in claim 14 wherein the mounting substrate means comprises a printed circuit board carrying printed circuit traces leading from at least some of the notches, and wherein each notch comprises a plated through region connected to the segment by a conductive bonding means, and wherein the printed circuit traces establish electrical connection between the said segments and the fixed switch contacts.

16. The variable inductor assembly set forth in claim 12 wherein the conductive fingers are electrically connected in parallel and wherein the moving contacts make progressive contact with the fixed contacts thereby to short out the successive turns connected to the fixed contacts actually contacted by the moving contacts.

17. The variable inductor assembly set forth in claim 12 wherein opposite end regions of the rotatable cam are mounted to two mounting blocks secured to the mounting substrate means, the mounting blocks forming journals which enable the cam to be rotated.

18. The variable inductor assembly set forth in claim 17 wherein the rotatable cam defines progressive discrete steps aligned with the fingers, and further comprising detent-providing means formed in at least one of the mounting blocks and associated with the rotatable cam for limiting the rotation of the cam to steps which correspond in pitch substantially with angular positions of the steps, so that each detent corresponds to a predetermined connection arrangement between the fixed contacts and the contacts carried by the fingers.

* * * * *